US009435202B2

(12) United States Patent
Rafalski et al.

(10) Patent No.: US 9,435,202 B2
(45) Date of Patent: Sep. 6, 2016

(54) COMPRESSED FLUID MOTOR, AND COMPRESSED FLUID POWERED VEHICLE

(71) Applicant: ST. MARY TECHNOLOGY LLC, St. Marys, OH (US)

(72) Inventors: Leroy J. Rafalski, Hoffman Estates, OH (US); Mark Langsdon, St. Marys, OH (US); Eric Langsdon, St. Marys, OH (US)

(73) Assignee: ST. MARY TECHNOLOGY LLC, St Marys, OH (US)

( * ) Notice: Subject to any disclaimer, the term of this patent is extended or adjusted under 35 U.S.C. 154(b) by 664 days.

(21) Appl. No.: 13/786,008

(22) Filed: Mar. 5, 2013

(65) Prior Publication Data

US 2013/0327206 A1 Dec. 12, 2013

Related U.S. Application Data

(63) Continuation-in-part of application No. 12/206,713, filed on Sep. 8, 2008, now Pat. No. 8,640,450.

(60) Provisional application No. 60/970,838, filed on Sep. 7, 2007.

(51) Int. Cl.

| | |
|---|---|
| ***F16D 31/02*** | (2006.01) |
| ***F01B 25/14*** | (2006.01) |
| ***F01B 25/04*** | (2006.01) |
| ***F04B 9/02*** | (2006.01) |
| ***F01B 1/08*** | (2006.01) |
| ***F01B 9/02*** | (2006.01) |

(52) U.S. Cl.

CPC ..... *F01B 25/14* (2013.01); *F01B 1/08* (2013.01); *F01B 9/023* (2013.01); *F01B 25/04* (2013.01); *F04B 9/02* (2013.01); *F04B 9/025* (2013.01)

(58) Field of Classification Search

CPC ..... F01B 1/08; F01B 9/023; F01B 9/026; F01B 25/04; F01B 25/14; F04B 9/025

USPC ..... 60/370; 91/248, 275, 493

See application file for complete search history.

(56) References Cited

U.S. PATENT DOCUMENTS

| | | | |
|---|---|---|---|
| 2,122,676 | A | 7/1938 | Bourke |
| 2,122,677 | A | 7/1938 | Bourke |
| 2,172,670 | A | 9/1939 | Bourke |
| 3,220,316 | A | 11/1965 | Kummerman |
| 3,925,984 | A | 12/1975 | Holleyman |
| 4,013,048 | A | 3/1977 | Reitz |

(Continued)

FOREIGN PATENT DOCUMENTS

| | | | |
|---|---|---|---|
| JP | 2002-256803 | A | 9/2002 |
| WO | 00-15964 | A1 | 3/2000 |

OTHER PUBLICATIONS

Bourke Engine Documentary by Lois Bourke, Tesla Book Co., Greenville, TX 75403, Copyright 1968.

(Continued)

*Primary Examiner* — Michael Leslie

(74) *Attorney, Agent, or Firm* — Vorys, Sater, Seymour and Pease LLP; William L. Klima

(57) ABSTRACT

A compressed fluid motor comprising at least one solenoid valve, motor timing sensor, and controller for operating the motor.

25 Claims, 14 Drawing Sheets

(56) References Cited

U.S. PATENT DOCUMENTS

| | | | |
|---|---|---|---|
| 4,094,227 | A | 6/1978 | King |
| 4,106,391 | A | 8/1978 | Wheeler |
| 4,203,351 | A | 5/1980 | Schwind |
| 4,478,132 | A | 10/1984 | Braddock |
| 4,507,918 | A | 4/1985 | Holleyman |
| 4,512,291 | A | 4/1985 | Kirk |
| 4,596,119 | A | 6/1986 | Johnson |
| 4,598,628 | A | 7/1986 | Courtright |
| 4,609,045 | A | 9/1986 | Rogers |
| 4,876,991 | A | 10/1989 | Galitello, Jr. |
| 4,889,035 | A | 12/1989 | Goodnow |
| 4,957,074 | A | 9/1990 | Weissler, II et al. |
| 5,165,579 | A | 11/1992 | Lund |
| 5,327,863 | A | 7/1994 | Downton et al. |
| 5,351,599 | A | 10/1994 | Stoll |
| 6,065,440 | A | 5/2000 | Pasquan |
| 6,598,392 | B2 | 7/2003 | Majeres |
| 6,827,058 | B1 | 12/2004 | Falero |
| 6,840,151 | B1 | 1/2005 | Barker et al. |
| 7,100,493 | B2 | 9/2006 | Nomura |
| 7,104,227 | B2 | 9/2006 | Roberts |
| 7,328,682 | B2 | 2/2008 | Fisher |
| 8,640,450 | B2 * | 2/2014 | Rafalski, Jr. ..... F01B 1/08 60/370 |
| 2004/0026145 | A1 | 2/2004 | Lan |
| 2005/0224059 | A1 | 10/2005 | Negre et al. |
| 2007/0101712 | A1 | 5/2007 | Negre et al. |
| 2009/0013681 | A1 | 1/2009 | Courtright |

OTHER PUBLICATIONS

Hot Rod Magazine, The Bourke Two-Stroke a Revolutionary Engine by George Hill, Copyright 1954 by Trend, Inc. Los Angeles, CA, pp. 18-21 and 52, vol. 7, No. 7, Jul. 1954.

CBA-Series Scotch-Yoke. Pneumatic Actuators, Emerson Process Management product brochure, Bettis Bulletin # 20.00-4 Rev 9-02, Copyright 2002.

* cited by examiner

COMPRESSED FLUID MOTOR, AND COMPRESSED FLUID POWERED VEHICLE

RELATED APPLICATIONS

This application is a continuation-in-part of U.S. patent application Ser. No. 12/206,713 filed on Sep. 8, 2008, which claims priority benefits under 35 U.S.C. §119 to U.S. Provisional Application No. 60/970,838 filed on Sep. 7, 2007, both incorporated by reference herein.

FIELD

This application relates to compressed fluid motors, and compressed fluid powered vehicles.

BACKGROUND

Public awareness and recent legislation has brought upon a need for a clean and environmentally responsible motor technology. Fuel burning engines are designed to consume refined fossil fuels but still produce unhealthy emissions. Higher fuel costs and maintenance costs are now associated with fuel burning engines. Previous attempts with fuel engines using straight line force to convert to rotary motion has been offered but with unsuccessful results. The most popular is the Bourke engine. This gasoline engine never achieved recognition and still would rely on fossil fuels as the source of power.

Electric motors are efficient but use large amounts of power for continuous usage. The limiting factor appears to be the storage of heavy battery cells for mobile applications. Recharging requires hours and the range of travel does not allow for extended distances. The spent storage batteries are a potential hazard to the environment if not disposed of properly. High expenses associated with constant recharging, maintenance and eventual battery replacement would be required. An alternative motor is required because of these shortcomings in current technology.

SUMMARY

A first object is to provide an improved compressed fluid motor.

A second object is to provide a compressed fluid motor comprising or consisting of an electronic control or pneumatic control configured to control the pressurization of the cylinder of the motor to operate the motor.

A third object is to provide a compressed fluid motor comprising or consisting of an electronic programmable logic controller or pneumatic programmable logic controller configured to control the pressurization of the cylinder of the motor to operate the motor.

A fourth object is to provide a compressed fluid motor comprising or consisting of a sensor for detecting the timing of the motor, and an electronic control or pneumatic control configured to control the pressurization of the cylinder of the motor to operate the motor, the sensor being linked to the control so as to input a signal from the sensor to the control.

A fifth object is to provide a compressed fluid motor comprising or consisting of a sensor for detecting the timing of the motor, and an electronic programmable logic controller or pneumatic programmable logic controller configured to control the pressurization of the cylinder of the motor to operate the motor, the sensor being linked to the control so as to input a signal from the sensor to the control.

A six object is to provide a compressed fluid motor comprising or consisting of an motor body, a drive shaft rotatably disposed within the motor body, a cylinder connected to the motor body, a piston slidably disposed within the cylinder, a piston rod connecting the piston rod to the crankshaft, a fluid valve operatively connected to the cylinder for selectively releasing pressurize fluid into the cylinder; electric sensor configured to sense the timing of the motor; and an electric control unit connected to the electric sensor configured to control the release of pressurized fluid into the cylinder to drive the motor.

A seventh object is to provide a compressed fluid powered vehicle.

An eighth object is to provide a compressed fluid powered vehicle comprising or consisting of a compressed fluid powered motor set forth in the above objects.

A ninth object is to provide a compressed fluid powered vehicle comprising or consisting of a compressed fluid powered motor, and at least one pressurized fluid tank.

A tenth object is to provide a compressed fluid powered vehicle comprising or consisting of a compressed fluid powered motor, at least one pressurized fluid tank, and a control configured control the release for pressurized fluid from the at least one pressurized fluid tank to the compressed fluid motor to operate the compressed fluid motor.

An eleventh object is to provide a compressed fluid powered vehicle comprising or consisting of a compressed fluid powered motor, at least one pressurized fluid tank, a motor control configured control the release for pressurized fluid from the at least one pressurized fluid tank to the compressed fluid motor to operate the compressed fluid motor, and a transmission or transaxle.

A twelfth object is to provide a compressed fluid powered vehicle comprising or consisting of a compressed fluid powered motor, at least one pressurized fluid tank, a motor control configured control the release for pressurized fluid from the at least one pressurized fluid tank to the compressed fluid motor to operate the compressed fluid motor, and a transmission or transaxle, the motor control and/or the transmission or transaxle configured to control the speed of the vehicle.

A thirteenth object is to provide a compressed fluid powered vehicle comprising or consisting of a compressed fluid powered motor and a compressed fluid source comprising a high pressure fluid tank and a low pressure fluid tank.

A fourteenth object is to provide a compressed fluid powered vehicle comprising or consisting of a compressed fluid powered motor, a high pressure fluid tank, a low pressure fluid tank, a high pressure regulator connected between the high pressure tank, and a pressure line connecting the lower pressure tank to the compressed fluid motor.

A fourteenth object is to provide a compressed fluid powered vehicle comprising or consisting of a compressed fluid powered motor, a high pressure fluid tank, a low pressure fluid tank, a high pressure regulator connected between the high pressure tank, and a pressure line connecting the lower pressure tank to the compressed fluid motor.

A fifteenth object is to provide a compressed fluid powered vehicle comprising or consisting of a compressed fluid powered motor, a high pressure fluid tank, a low pressure fluid tank, a high pressure regulator connected between the high pressure tank, a pressure line connecting the lower pressure tank to the compressed fluid motor, and a low pressure regulator connected between the low pressure tank and the compressed fluid motor.

The compressed fluid motor can be constructed with a single cylinder, multiple cylinders, horizontally opposed cylinders, vertically opposed cylinders, or other suitable combination.

The arrangement of a piston, cylinder, piston rod, drive shaft effectively transforms the linear motion of the piston rods into rotation of the drive shaft (e.g. crankshaft) to drive equipment or a vehicle. The compressed fluid motor will achieve full advantage of converting linear motion into rotational motion through the drive shaft.

An important aspect is to provide a viable alternative to electric motors and combustible fuel engines. The compressed fluid motor can be used for any application that requires rotational motion to perform a duty (e.g. run equipment, drive a vehicle). The compressed fluid motor can useful like electric motors and combustible fuel engines of similar size to perform the same type of work. The compressed fluid motor can also be utilized in new product designs and advanced applications.

The compressed fluid powered vehicle is powered with the compressed fluid motor. The compressed fluid motor can directly drive the vehicle (e.g. directly coupled to wheel), or can be coupled to one or more drive components, including transmission, transaxle, gear(s), drive shaft, differential to power one or more wheels, tracks, or other suitable ground contact drive components.

The compressed fluid powered vehicle is fitted with one or more pressurized fluid tanks to provide a source of pressurized fluid to operate the compressed fluid powered motor to drive the vehicle. For example, the compressed fluid powered vehicle is fitted with a high pressure fluid tank, which allows for storage of a large amount of fluid (e.g. high pressure air (e.g. 4,000 to 5,000 psi) or liquefied gas), connected to a lower pressure tank (e.g. by a pressure line or hose). A high pressure regulator is provided between the high pressure tank and lower pressure tank (e.g. physically connected to one tank, inline, in the pressure line) to control and reduce the pressure in the lower pressure tank. A low pressure regulator is provided between the lower pressure tank and the compressed fluid motor to lower the gas pressure to the operating gas pressure of the compressed fluid motor. This tank and regulator arrangement allows for a large volume of fluid (i.e. gas or liquid) to be stored on board the vehicle, and provides for a very consistent and stable steady state supply of low pressure gas (e.g. operating pressure of gas required to drive motor (e.g. 100 psi) into the compressed vehicle motor to operate same).

A motor control is provided to control the release of pressurized fluid from a source (e.g. one pressurized fluid tank, or a series of pressurized fluid tanks) to the compressed fluid motor. The control can be configured to be an on/off control valve, a differential flow valve configured to variably control the pressure and/or rate of fluid (e.g. cubic feet per minute (i.e. CFM)) delivered to the compressed fluid motor (e.g. a control valve or valve is one or more of the pressure line(s) supplying the compressed fluid motor).

In one embodiment of the compressed fluid powered vehicle, the motor control is an on/off control valve provided at a location between the pressurized fluid source and the compressed fluid motor to provide a fixed operation supply of pressurized gas to motor. In this embodiment, the compressed fluid motor is operated at a fixed speed (e.g. 2,000 to 3,000 revolutions per minute (rpm)). The compressed fluid motor is couple to a transmission or transaxle (e.g. manual with clutch, or automatic without clutch) configured to control the speed of the vehicle from zero to a maximum speed (e.g. including a regulator to control maximum speed of vehicle).

In another embodiment of the compressed fluid powered vehicle, motor control is a differential flow control valve to variably control the pressure and/or rate (e.g. CFM) of compressed fluid on the downstream side of the differential control valve. This arrangement allows the pressure and rate (e.g. CFM) to be delivered to the compressed fluid motor to control the speed of the compressed fluid motor. In this embodiment, the compressed fluid motor can directly drive the wheel(s), track(s), or other ground engaging drive components, or can be coupled to a manual or automatic transmission. The transmission can be configured to also control the speed of the vehicle (e.g. through gears) in addition to the compressed fluid motor.

The compressed fluid motor and/or vehicle can be provided with a generator or alternator powered by the compressed fluid motor to convert mechanical energy or movement into a electrical supply to power electrical components of the compressed fluid motor and/or vehicle. For example, a generator or alternator is mechanically coupled to the drive shaft of the motor by a bracket, pulleys, and pulley belt to provide an electrical supply.

The compressed fluid motor can also be connected to one or more motors (e.g. combustible fuel motor or engine, electric motor) to provide a hybrid motor arrangement. For example, the compressed fluid motor is coupled to a gasoline or diesel engine so that when the supply of compressed fluid is exhausted, the vehicle can be operated with the gasoline or diesel engine instead of the compressed fluid motor. As another example, the compressed fluid motor is couple to an electric motor so that the compressed fluid motor drives the electric motor, which in turn drives the vehicle (e.g. electric motor coupled to transmission or transaxle, electric motor provides electric power to one or more remotely located electric drive motor(s) directly coupled to a wheel(s). Alternatively, or in addition, the electric motor can also couple to a battery assembly or array to charge the batteries when the compressed fluid motor is operating, and/or when the vehicle is braking using the electric motor to brake the vehicle. Even further, the compressed fluid motor and electric motor are operated simultaneously to drive the vehicle to boost the driving torque delivered, momentarily or continuously, to the drive arrangement of the vehicle.

The exhaust of the compressed fluid motor can be used to cool the compressed fluid motor, vehicle and/or operator/passenger of vehicle. For example, through ductwork, the exhaust of the compressed fluid motor is directed through vents to the driver/passenger compartment of the vehicle. A temperature control (e.g. electric fan motor and control, thermostat) and fluid filter and/or fluid treatment arrangement can be provided to control the pressure and/or temperature of the vehicle driver/passenger compartment with the exhausted compressed fluid and/or to remove any moisture, lubricant or other contaminants of the exhausted compressed fluid reaching the vehicle driver/passenger compartment.

The details of the preferred embodiments and these and other objects and features of the inventions will be more readily understood from the following detailed description when read in conjunction with the accompanying drawings wherein:

DETAILED DESCRIPTION OF THE PREFERRED EMBODIMENTS

Figure 1:
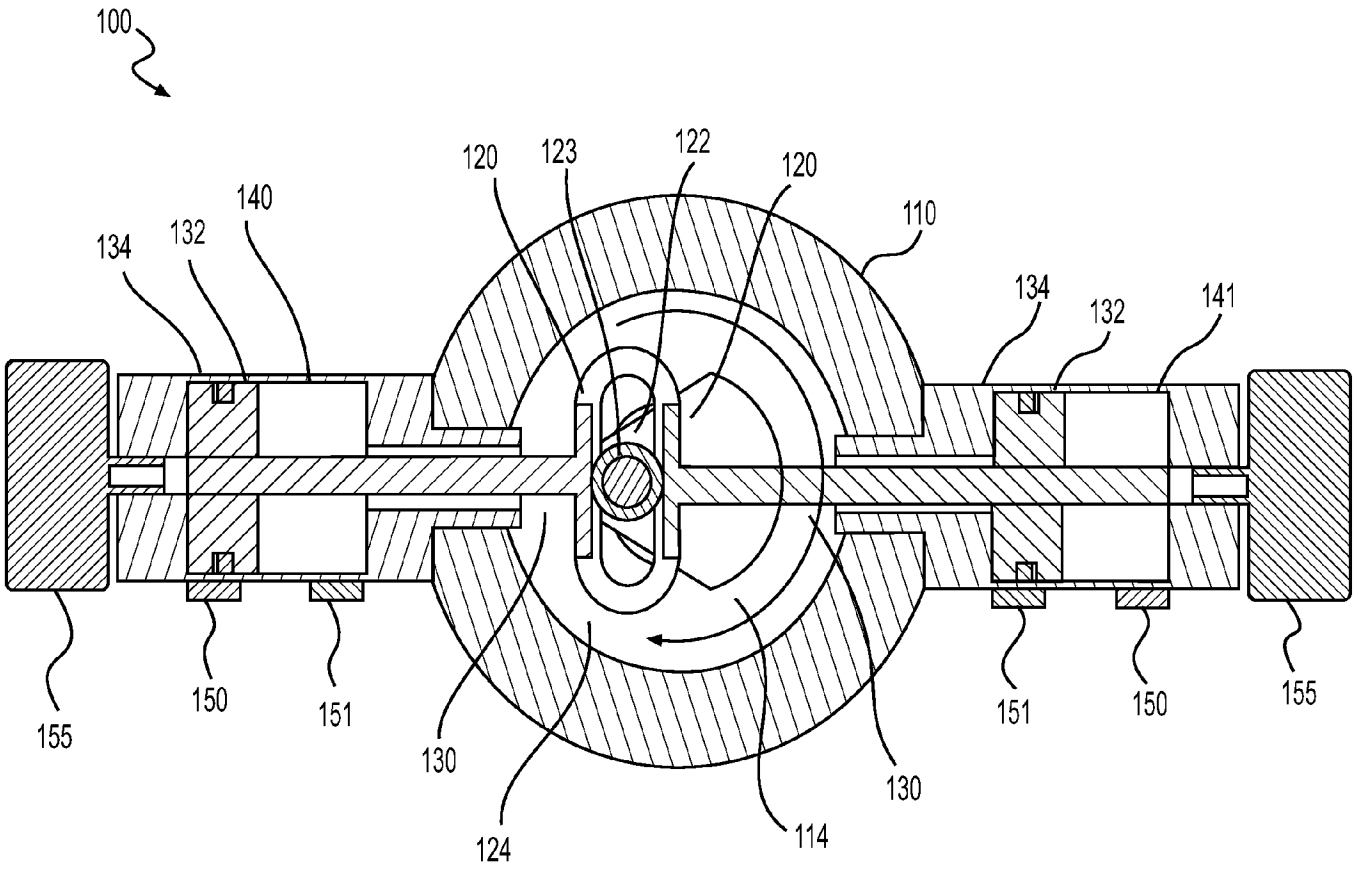
FIG. 1 is a diagrammatic cross-sectional view of the compressed fluid motor according to an embodiment.
Figure 2:
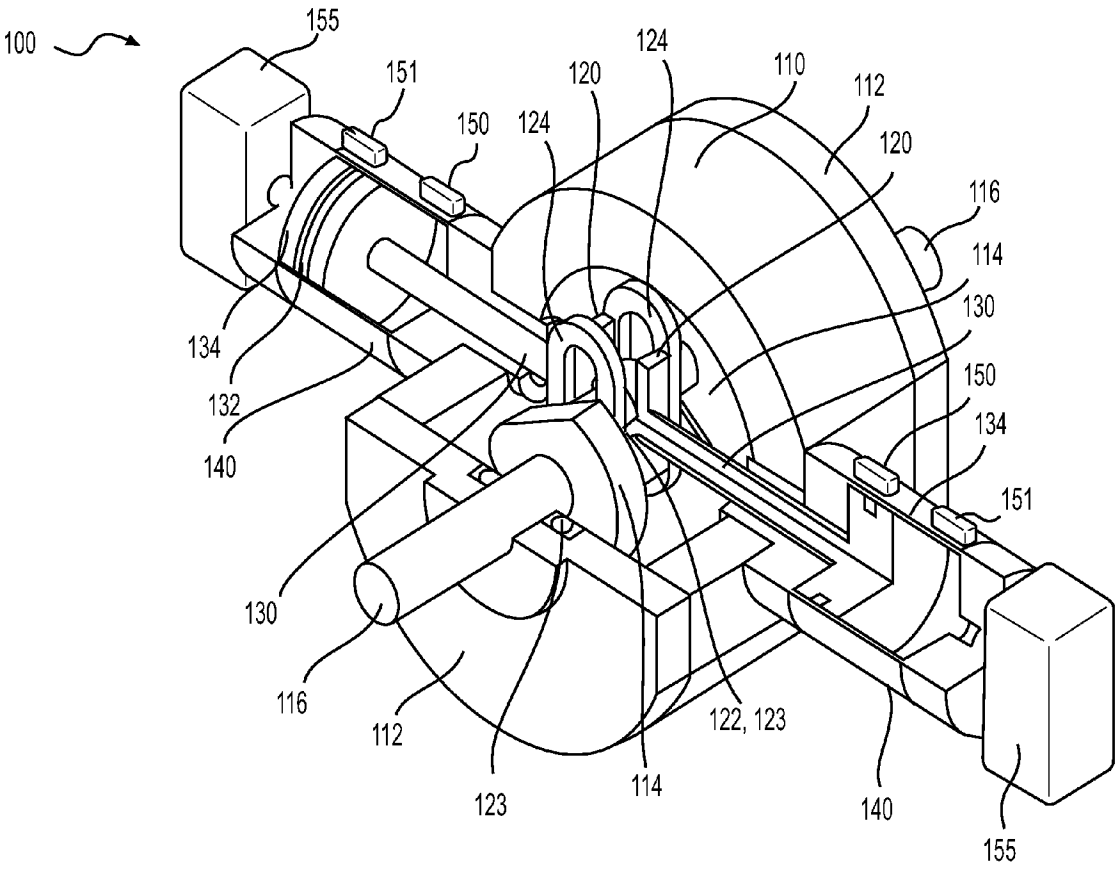
FIG. 2 is a partial cutaway perspective view of the compressed fluid motor shown in FIG. 1.

An embodiment of a compressed fluid motor 100 is shown in FIGS. 1 and 2. The compressed fluid motor 100 is configured to drive the pistons 134, 134 within the cylinders 140, 141, in only one direction (i.e. inwardly) relative to the main body 100.

An embodiment of a compressed fluid motor 100 is shown in FIGS. 1 and 2. The compressed fluid motor 100 is configured to drive the pistons 234, 234 of the compressed fluid motor 200 inwardly only towards the main body 110 within the cylinders 240, 241.

The compressed fluid motor comprises a rotational shaft to produce motion as an alternative to all electric motors and combustible fuel engines for current and future applications. Electric motors of any power usage or any combustible type engine could be replaced with this compressed air motor. This movement would be similar to that of a shaft on an electric motor or the shaft of a combustible engine. The compressed fluid medium will be any compressible gas including, but not limited to air, nitrogen, propane, natural gas, steam, carbon dioxide, gas mixture, or other suitable gas. This also applies to any compressible liquid, including but not limited to hydraulic fluid, water and/or any other compressible liquid deemed safe and appropriate for this application. The pressures for this compressed fluid medium would be from zero PSI (Pounds per Square Inch) to any pressure that could be used to exert force and create motion in this compressed fluid motor.

The compressed fluid motor can also be a motor, part or component of a hybrid motor drive system. For example, the fluid motor can be used in combination with an electric motor and/or a combustible fuel motor in a hybrid motor drive system.

The motor comprises common and unique components to impart rotation to a shaft or shafts. The following components and drawings explain the motor.

FIG. 1 is a diagrammatic cross-sectional view of the compressed fluid motor 100. FIG. 2 is a partial cutaway perspective view of the compressed fluid motor 100.

The compressed fluid motor 100 comprises a main body 110, which is the support structure for the inner and outer workings of the compressed fluid motor 100. The main body 110 can be any shape or size to accommodate the interior and/or exterior components for a complete or sub assembled unit. The material of the main body 110 can be any plastic, composite, carbon fiber, Kevlar, fiberglass, ceramic, wood, metal and/or any natural or synthetic material that can be effectively used for this intended purpose.

The compressed fluid cylinders 140, 140 can be mounted coaxially and oppositely in relation to the main body 110 and the crankshaft 116. Alternatively, the crankshaft 116 can be replaced by multiple crankshaft portions or crankshaft.

The cylinders 140, 140 can be of any design in regards to shape or volume as to having a cylinder body, piston body, piston rod 130, 130, pressure ports, seals, and/or rings to compress the fluid medium(s). The cylinders 140, 140 can be connected to the main body 110 by a variety of types of connection. For example, the connection of the cylinders 140, 140 to the main body 110 can include, but not limited to using threading, bolting, welding, making the cylinders 140, 140 and main body 110 as a single piece (e.g. molded, molded plastic, molded carbon fiber/resin, molded fiberglass/resin, molded ceramic, formed, cast, machined from block or billet of metal such a steel, aluminum, titanium), and any other connection type suitable to connect the cylinders 140, 140 to the main body 110. The cylinders 140, 140 can be special purpose for this design, or made or purchased commercially.

The compressed fluid motor is configured as a "double acting" design; however, the cylinders 140, 140 are only pressurized to sequentially "push" only on the tops of the pistons 134, 134. This creates a desirable mechanical advantage as the cylinder output forces are greater when pressure is applied at the upper piston surfaces (i.e. cap end), since pressure is applied to the surface area of the full face of pistons 134, 134. The cylinders 140, 140 can be used in any combination, for example, in a combination of multiples of two cylinders. A compressed fluid motor of this design can be assembled with two, four, six, eight, etc. number of cylinders as deemed appropriate for the desired power output. However, it should be noted that only a single piston/cylinder design is suitable to operation of a compressed fluid motor.

The cylinder head end port can be configured to provide extra force through pressurization or vacuum to assist the compressed fluid motor to turn in a forward or reverse rotation. The pressurized pistons 134, 134 and corresponding piston rods 130, 130 act on the main bearing 122 of the crankpin 123 to rotate the crankshaft 116. The crankshaft 116 is supported for rotation in the main body 110 by a pair of main bearings 123, 123 located on the end cover plates 112, 112 of the main body 110. The crankshaft 116 is provided with a pair of flywheels 114, 114. The piston rods 130, 130 are connected together by bearing guide plates 124, 124. The connection type between the piston rods 130, 130 can be, but is not limited, to threading, welding, pinning, casting, or being made as a single piece component. A pair of bearing guide plates 120, 120 are connected between the bearing guide plates 124, 124, and cooperate and ride on the main bearing 122 of the crankpin 123 to rotate the crankshaft 116.

The main bearing 122 of the crankpin 123 is designed to allow full rotation in a clockwise or counter-clockwise direction at the will of the forces involved. The bearing guides 120, 120 are designed to withstand the forces of compression while contacting the main bearing 122 of the crankpin 123 during rotation of the crankshaft 116. The crankpin 123 is located and confined between the two flywheels 114 of the same proportion for balancing the crankshaft drive assembly. Specifically, the crankpin 123 is designed to have a sufficient size and tapered ends to positively located the bearing guides between the flywheels 114, 114. Further, the bearing guides 120, 120 are designed to withstand the forces exerted thereon by pushrods 130, 130 during operation of the compressed fluid motor 100, and transfer the linear power exerted onto the crankpin 123 to turn the crankshaft 116 a full 360 degrees in slow or rapid succession. The 360 degrees represents a full rotation of the crankshaft 116.

The crankshaft 116 is mounted through the center of each flywheel 114, 114, and is of a sufficient length to be suspended between the spaced apart bearings and seals 123, 123 provided in the end cover plates 112, 112. The ends of the crankshaft 116 pass through the end cover plates 112, 112 to connect to any type of device configured to harness the rotational motion of the crankshaft 116 (e.g. gear, clutch, drive, transmission, and differential).

The control system comprises a solenoid operated directional control valve 155 provided on an upper portion of each cylinder 140, 141. The two (2) cylinders 140, 141 have the same design, including the same size bore and stroke. A reed switch 150, normally open, is mounted at a lower end of each cylinder 140, 141. A reed switch 151, normally closed, is mounted at an upper end of each cylinder 140, 141. There exists two relays to continue electrical current through a full power stroke, fittings of sufficient size and pressure rating to connect all devices; and a tubing for distribution of the compressed fluid such as, but not limited to air, nitrogen, propane, natural gas, steam, carbon dioxide, etc. This also applies to any compressible liquid to include, but not limited to hydraulic fluid, water and/or any other compressible liquid deemed safe and appropriate for this application. The tubing can be made, but not limited to plastics or metals of sufficient pressure rating.

The compressed fluid is supplied to and controlled through the solenoid operated directional control valves 155, 155 of cylinders 140, 141. The operation of the control valves 155, 155 is timed and controlled to release compressed fluid into the cylinders 140, 141. Again, the magnetic pistons 134, 134 and piston rods 130, 130 are connected together by bearing guide plates 120 and bearing guide plates 124. The linear motion of the piston rods 130, 130 is converted into rotational motion by the bearing guide plates 120, 120 pushing on the main bearing 122 of the crankpin 123 resulting in a 360 degree controlled and balanced motion of the crankshaft 116 and flywheels 114. The crankshaft 116 is connected to the work. The work can be a pulley, shaft or other type of coupler. The primary principle of operation is achieved through converting the linear motion of the compressed fluid cylinders 140, 141 into rotational motion of the crankpin 123, crankshaft 116, and flywheels 114, 114. The arrangement can be modified to perform the same functions with design changes. The actual size of this compressed fluid motor can also be scaled up or down to fit the parameters of the work required. The inner workings (main bearing 122, crankpin 123, flywheels 114, 114, crankshaft 116, bearing guides 120, 120, and bearing guide plates 124, 124) can be individual components or a combined assembly. The crankshaft 116 can comprise removable flywheels and a removable crankpin coupled with a key and keyway for maintenance or customization. This same device can be achieved in another embodiment by making a single piece crankshaft 116, crankpin 123, and flywheels 114, 114. This assembly can be made of plastic, composite, wood, metal and any other man made or natural material(s).

The magnetic pistons 134, 134 are at a fixed distance apart and move as one part or unit connected by the piston rods 130, 130, bearing guides 120, 120, and bearing guide plates 124, 124, as shown in FIG. 1. As the assembly moves back and forth (i.e. reciprocates), the bearing guide plates 124, 124 push on the main bearing 122 of the crankpin 123 and rotate the crankshaft 116 resulting in 360 degree motion on a fixed path around the centerline of the shaft 116. The main bearing 122, crankpin 123, flywheels 114, 114, and crankshaft 116 move together as a single assembly. This assembly converts linear motion and force from the pistons 134, 134 into a rotary force exerted on the crankshaft 116 and combined assembly.

Figure 3:
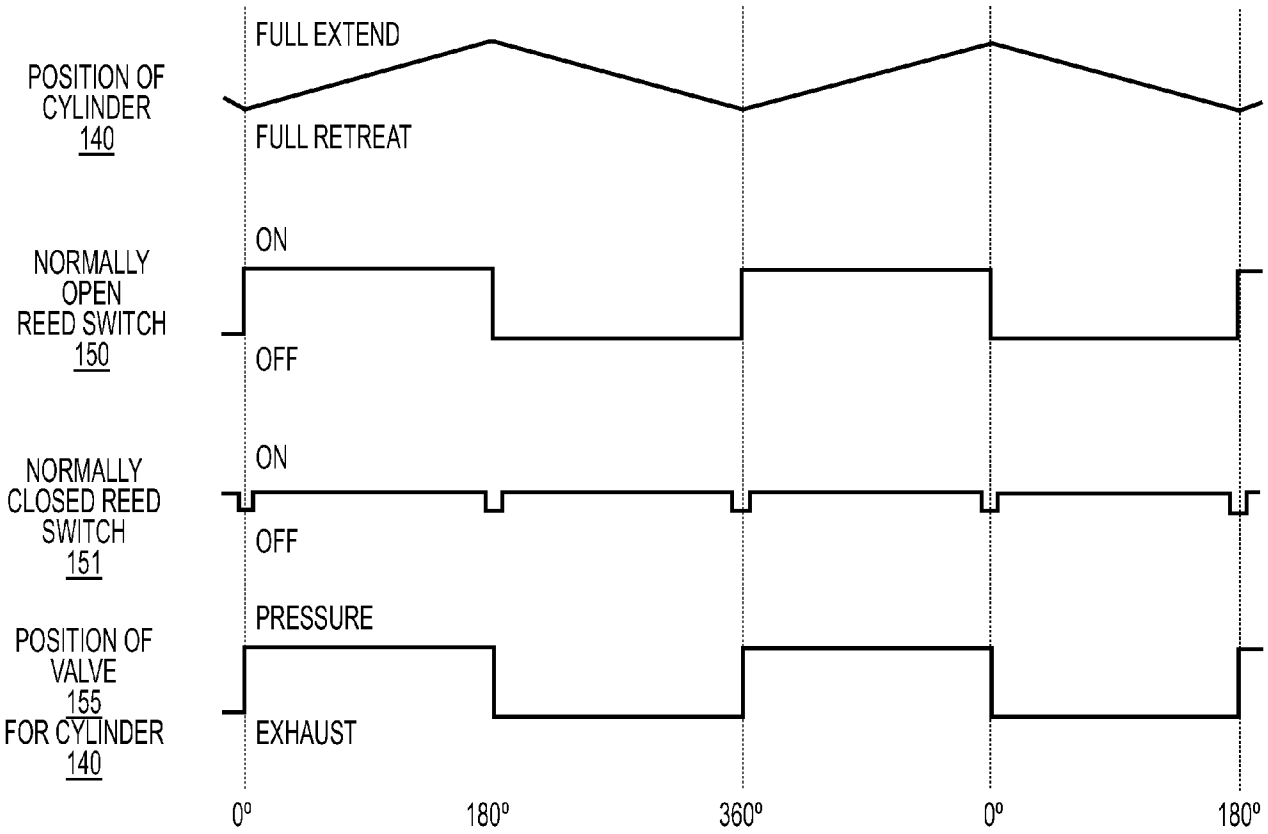
FIG. 3 is a timing diagram of the compressed fluid motor operation for the left cylinder in the embodiment shown in FIGS. 1 and 2.
Figure 4:
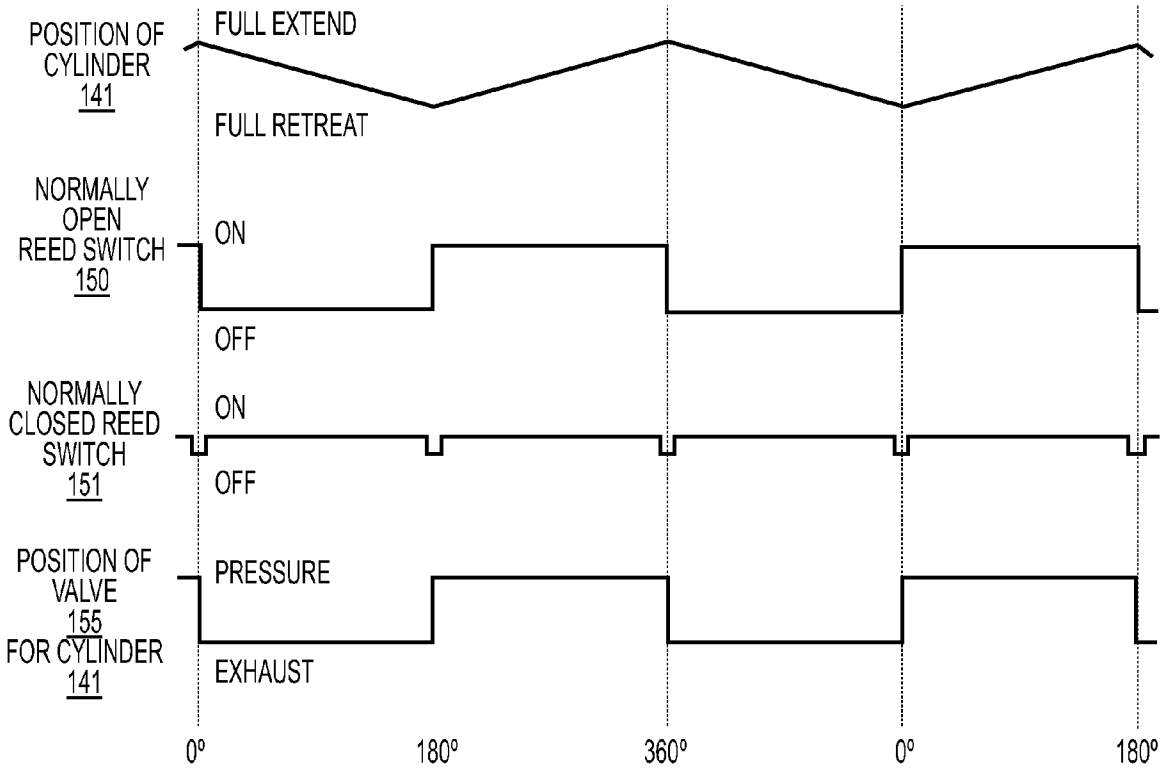
FIG. 4 is a timing diagram of the compressed fluid motor operation for the right cylinder in the embodiment shown in FIGS. 1 and 2.

FIG. 3 illustrates a timing diagram of the compressed fluid motor 100 operation for the left cylinder 140. FIG. 4 illustrates a timing diagram of the compressed fluid motor 100 operation for the right cylinder 141.

The magnetic piston 134 is located in the cylinder 140 at a fully retracted position. The magnetic strip 132 in cylinder 140 closes the normally open reed switch 150 on the cylinder 140. The reed switch 150 on cylinder 140 sends an electrical signal to the relay to maintain power to the control valve 155 on the cylinder 140. The control valve 155 on cylinder 140 opens and allows pressure into cylinder 140 to advance the magnetic piston 134 in cylinder 140 inwardly. The main bearing 122 and crankpin 123 begins to rotate around the centerline of the shaft 116 in FIG. 2. The magnetic piston 134 of cylinder 140 advances to a full inward position. The normally closed reed switch 151 deactivates the relay and power to the control valve 155 on cylinder 140. The pressure is removed and the control valve 155 on the cylinder 140 will exhaust and allow the pressure to escape from the cylinder 140. The main bearing 122, crankpin 123, flywheels 114, 114, and crankshaft 116 have moved 180 degrees from the start position.

The magnetic piston 134 located in cylinder 141 is at the full inward position. The magnetic strip 132 of the cylinder 141 closes the normally open reed switch 150 on cylinder 141. The reed switch 150 on cylinder 141 sends an electrical signal to the relay to maintain power to the control valve 155 on cylinder 141. The valve 155 on cylinder 141 opens and allows pressure into cylinder 141 to advance the magnetic piston 134 in cylinder 141 inwardly. The main bearing 122 and crankpin 123 begin to rotate around the centerline of the crankshaft 116, as shown in FIG. 2. The magnetic piston 134 of cylinder 141 advances to a full inward position. The normally closed reed switch 151 deactivates the relay and power to the control valve 155 on cylinder 141. The pressure is removed and the control valve 155 on cylinder will exhaust. The main bearing 122, crankpin 123, flywheels 114, and crankshaft 116 have moved 360 degrees from the start position. The pressure cycle, start position, begins again for cylinder 140.

An electrical power source is necessary to allow the reed switches 150 and 151, relays, and control valves 155 to activate for compressed fluid motor 100. Advanced designs of this compressed fluid motor may add or remove the electronics or shift the location of the control valves 155, 155 on the cylinders 140, 141 or to a remote location, for example, through use of auxiliary pressurized fluid lines.

Other components may include a compressed gas storage device for mobile applications. This compressed gas storage device can be a compressed fluid vessel or tank. It is also possible to produce compressed fluid at the point of use in a mobile or stationary application. A safety lockout device is recommended. This device can halt all pressure to the compressed fluid motor and all components in the circuit.

The use of the word "motor" is relevant to the understanding and description of this device. The word "motor" means a device to move objects at a controllable and sustainable rotating motion. A "fluid motor" best describes what the device is, and by what means it operates. Similar devices that use vanes or impellers use the word "motor" to describe their device. The comparison of the electric motor verses the internal combustion engine would support the description of this device to be considered a "motor" as it turns or spins around the crankshaft 116, but does not consume, by ignition, the power source to induce the rotating motion.

The pressure for a full stroke is an advantage over a gasoline type engine. The mechanical advantage of this motor design is by the use of straight line motion into pushing the main bearing 122 resulting in a continuous 360 degree motion. This controlled motion has a distinct advantage over the typical gasoline engine by applying the pressure through the full revolution of the crankshaft 116. A gasoline engine applies pressure to the top of the piston only at the highest point in the cylinder. This compressed fluid motor applies pressure for the full length of the piston travel. This sustained pressure allows this motor to achieve higher torque output then any gasoline engine equal in size and weight. The revolutions per minute (RPM) and torque values are controlled and repeatable for practical work to be performed. Higher torque can be achieved by allowing the compressed air into the cylinder for the full stroke length. Higher rotational speed can be achieved with higher pressures, quick acting valves, and switches.

Recapturing of compressed fluid once passed through the compressed fluid motor can be useful for other features or motors in a secondary system for regeneration. The fluid can pass through the compressed fluid motor, and then can be returned to a secondary low pressure tank. The advantage is that it is easier to compress fluid from 100 PSI (7 bar) to 200 PSI (14 bar) then to go from 14.7 PSI (1.03 bar) to 200 PSI (14 bar). The 200 PSI (14 bar) would also be available as a reserve for startup or extra boost to the system.

The process of storing compressed air and reintroducing compressed fluid from the motor would be relevant for maximum efficiency of an enclosed circuit. The compressed fluid motor can be allowed to continually operate, and be driven by a transmission, pulley, belt or other means for the purpose of placing compressed fluid back into the system. Such could be applied to regenerative braking through the use of control valves 155 placed in the circuit with an advantage of increased range and usefulness of the compressible fluid motor in mobile applications.

The use of electronics over mechanical controls for the compressed fluid motor provides flexibility. The prototype compressed fluid motor (bench tested without a load) was capable of 750 revolutions per minute (RPM) at 40 PSI (2.8 bar). The bearing and seal 123 were rated for 10,000 RPMs, and the cylinders 140,141 were rated for 250 PSI (17.5 bar). Limitations for this bench test were the compressor (150 PSI or 10.5 bar maximum) which could be overcome with a 3000 PSI (210 bar) tank and pressure regulator set to 250 PSI (17.5 bar).

The compress fluid motor can use a mechanical valve arrangement. The compressed fluid can be introduced into the cylinders 140, 141 by a mechanical control. For example, a mechanical intake valve can open and allow pressure into the cylinder 140,141, push the piston through full stroke and then close to release the pressure through an exhaust valve. This would be done with a push rod located through the case and timed to the position of the main bearing 122, crankshaft 11, or flywheels 114. This assembly can be beneficial for fixed applications that do not require the flexibility that electronics provide.

The opening and closing of the control valves 155, 155 can be adjusted to achieve and maintain the ideal operation and requirements of the compressed fluid motor. The control valves 155, 155 timing would be preset for maximum speed and/or maximum torque for desired operation.

Further developments of this fluid motor can be to add or remove electrical components for desired fluid motor operation. Electrical controls can be replaced or supplemented with air controlled valves, mechanical valves, or any other devices configured to pressurized or exhaust the cylinders.

The cycles are completed in rapid succession, and create useful work similar to that of a combustion engine or an electric motor. The compressed fluid motor produces torque characteristics of an electric motor with pressure developed through the entire cycle and movement of the shaft. The maintaining pressure into the cylinders allows for more torque and revolutions per minute. The power derived from the compressed fluid motor produces more power than any combustion engine of equivalent cylinder volume. The compressed fluid motor can be useful for mobile or stationary applications as an alternative to an electric motor and/or internal combustion engine. The compressed fluid motor provides power generation of a low weight to power ratio in favor of the mechanical advantage of converting linear motion into rotational motion.

Advanced Compressed Fluid Motor

Figure 5:
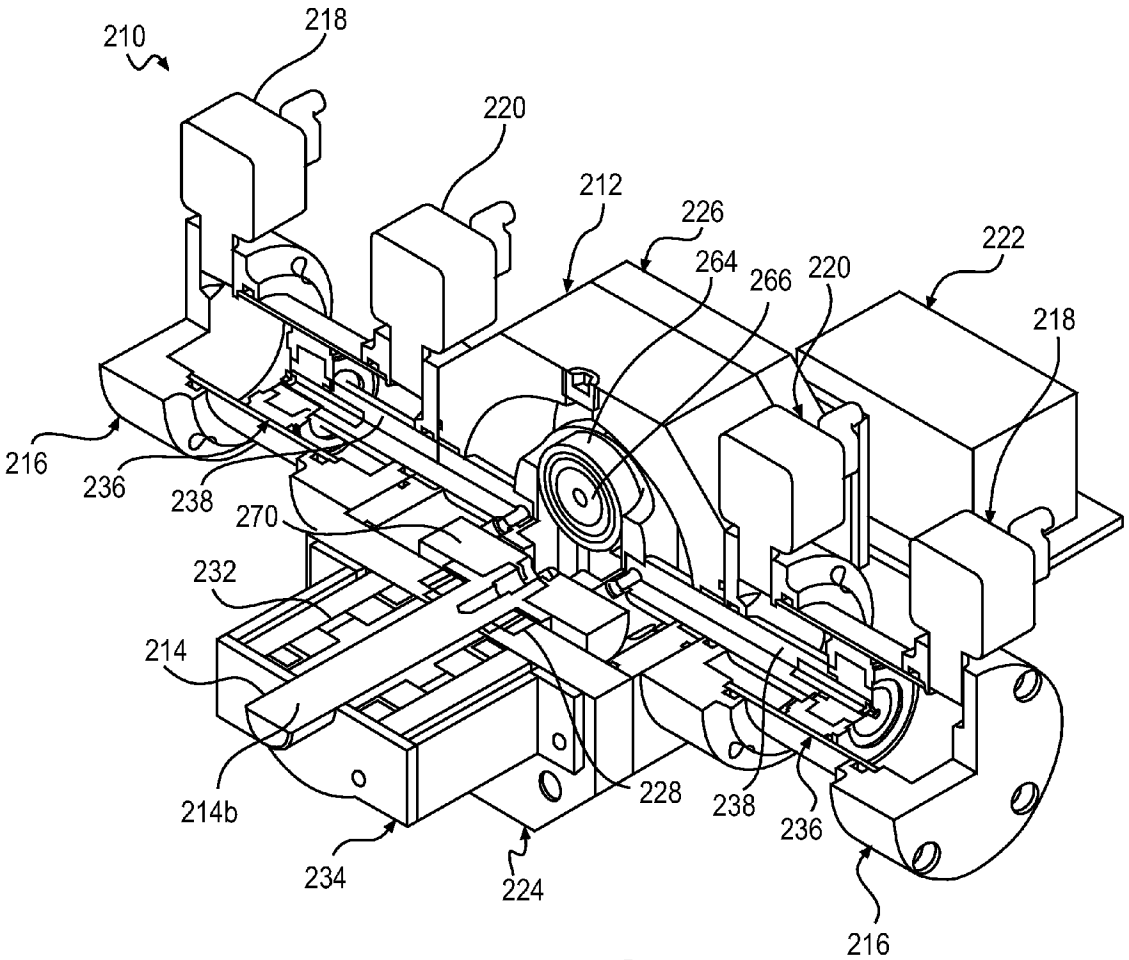
FIG. 5 is a diagrammatic perspective view of another embodiment of an advanced pressurized fluid motor.

Another embodiment of a compressed fluid motor 210 is shown in FIGS. 5-. The compressed fluid motor 210 is configured to drive the pistons 234, 234 within the cylinders 240, 241, in both directions (i.e. inwardly and outwardly) relative to the main body 200.

Figure 7:
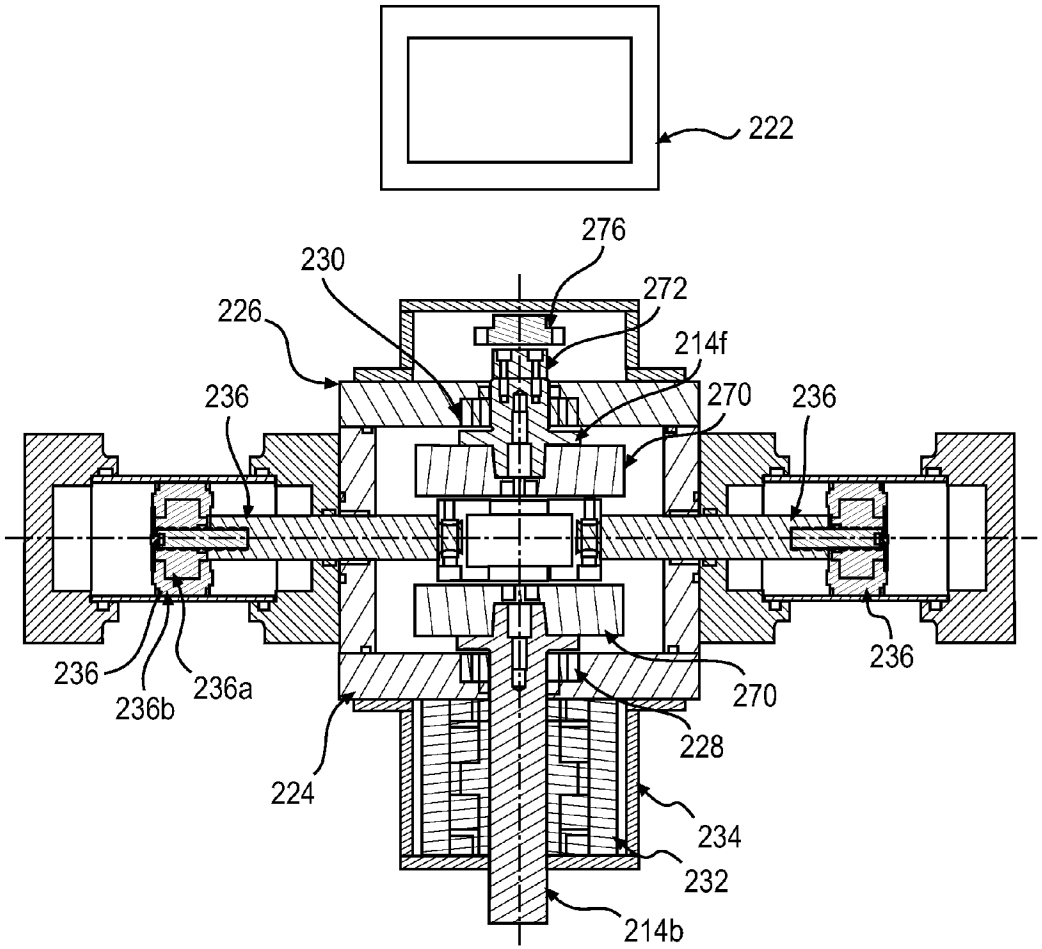
FIG. 7 is a diagrammatic top horizontal mid-sectional view of the advanced pressurized fluid motor shown in FIGS. 5 and 6.

The compressed fluid motor 210 comprises an motor body 212 fitted with a motor drive shaft 214. The motor body 212 is connected to a pair of opposed cylinders 216, 216. The cylinders 216, 216 are each fitted with an upper solenoid valve 218 and lower solenoid valve 220. Each set of solenoid valves 218, 218, 220, 220 are wired to and controlled by programmable logic controller (PLC) 222 (FIG. 7). Further, the solenoid valves 218, 218, 220, 220 are electrically operated solenoid valves to selectively pressurize or exhaust the cylinders 216, 216 in a controlled manner to be described below. The solenoid valves, for example, have three (3) ports. The modes of operation of the solenoid valves, include pressurize, exhaust, and open to atmosphere. The solenoid valves can be, for example, Prospector Series, Poppet Valves manufactured by Norgren, Littleton, Colo., Model No. [indicate model number], www.norgren.com).

A front motor cover 224 and rear motor cover 226 are connected to the motor body 212 (e.g. by bolts), as shown in FIGS. 5 and 7. For example, the front motor covers 224, 226 are motor cover plates. The front motor cover 224 comprises a front bearing and seal 228, and the rear motor cover 226 comprises a bearing and seal 230 (FIG. 7). The seal 228 can be the same as the seal 230.

A cam clutch 232 is disposed within a cam clutch housing 234 connected to the front of the motor body 212. The cylinder 216, 216 are connected to opposed sides of the motor body 212 (e.g. by bolting).

A piston 236 is slidably disposed within each cylinder 216. Each piston 236 comprises an inner piston body 236*a*. The piston, for example, can comprise an outer piston body 236*b* (e.g. made of polyurethane) fitted over the inner piston body 236*a* (e.g. made of aluminum). The pistons 236, 236 do not have piston rings; however, more advance piston can have one or more piston rings.

Figure 6:
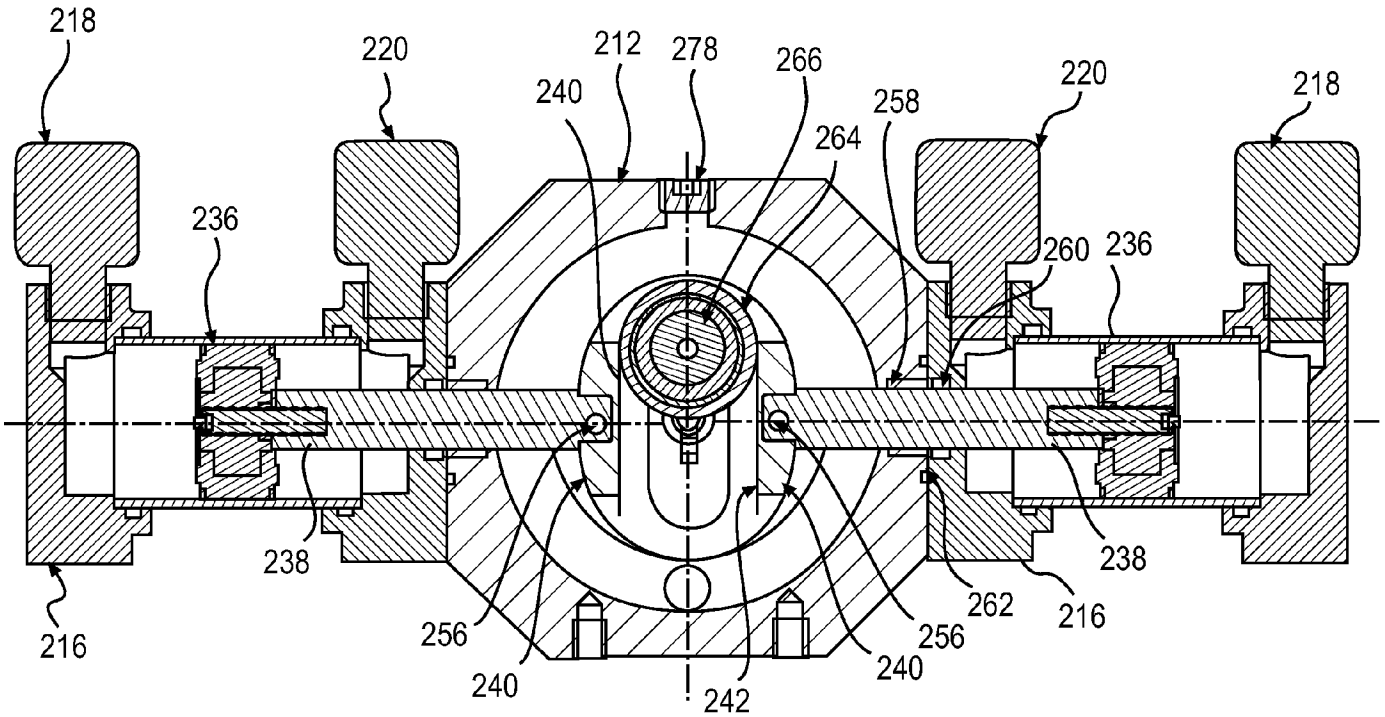
FIG. 6 is a diagrammatic front vertical mid-sectional view of the advanced pressurized fluid motor shown in FIG. 5.
Figure 8:
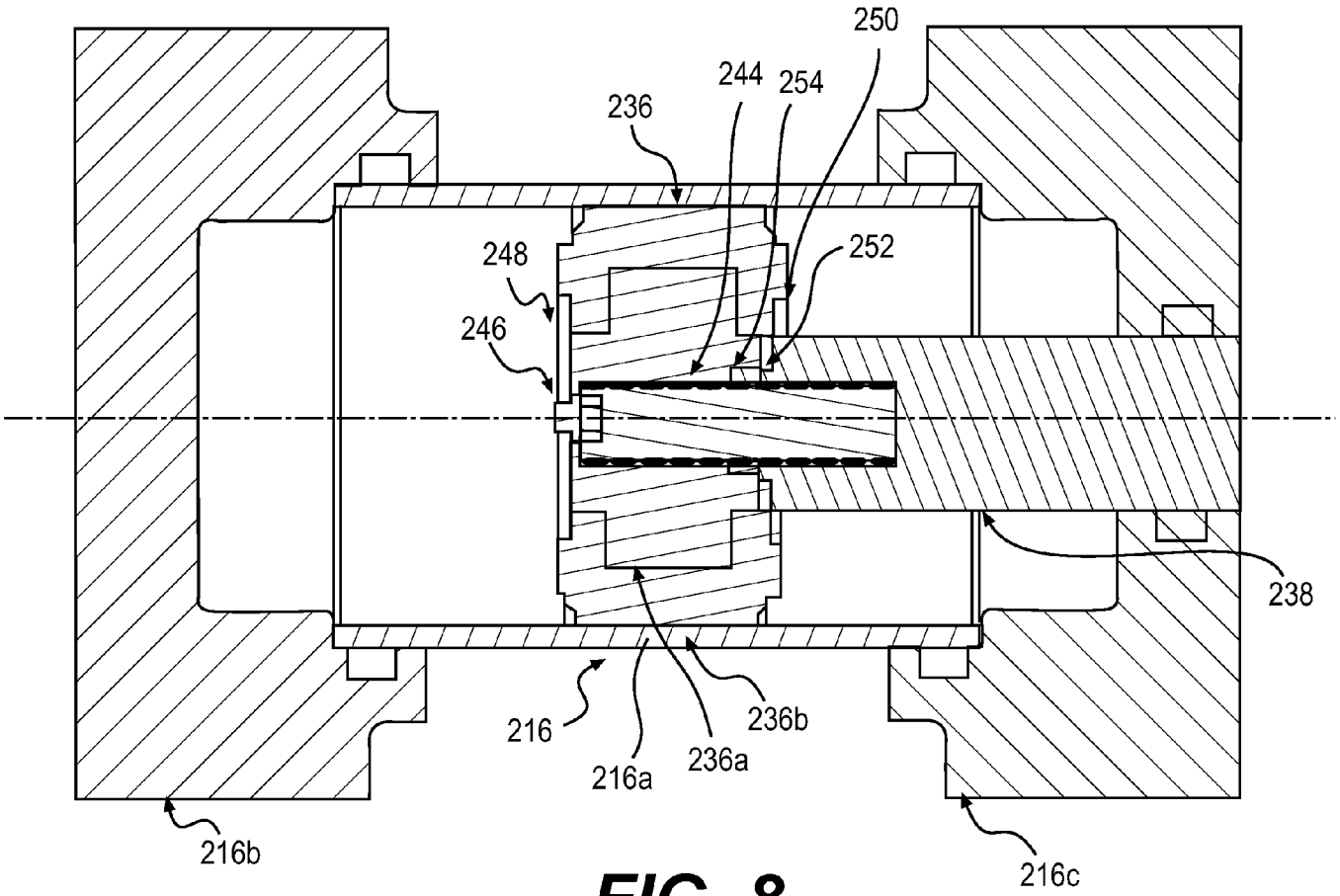
FIG. 8 is a diagrammatic partial broken away enlarged view of the piston and cylinder arrangement of the advanced pressurized fluid motor shown in FIGS. 5-7.

A piston rod 238 connects each piston 236 to a bearing guide 240 connected to a bearing guide plate 242 (FIG. 6). As shown in FIG. 8, a threaded fastener 244 connects into an outer end of each piston rod 238, and a threaded fastener 246 connects into an outer end of each threaded fastener 244 to secured each piston 236 onto the outer end of each piston rod 238. An outer washer 248 and inner washers 250, 252 further anchor each piston 236 onto each piston rod 238. An annular bearing 252 is provided on an inner side of each inner piston body 236*a*. Each piston rod 238 is connected to each bearing guide 240 with a pin 256, as shown in FIG. 6.

As shown in FIG. 6, the motor body 212 is fitted with bearings 258, 258 for accommodating the piston rods 238, 238. Further, the cylinders 216, 216 are fitted with bearings 260, 260 for also accommodating the piston rods 238, 238. The motor body 212 is also provided with seals 262, 262 (e.g. sealing rings or O-rings located in recess of the side faces of the motor body 212) for cooperating and sealing with the inner end face surfaces of each cylinder. This arrangement slidably supports the piston rods 238, 238 within the compressed fluid motor 210 while providing a pressure seal between the motor body 212 and cylinders 216, 216.

The pistons 236, 236, piston rods 238, 238, bearing guide plates 240, 240, and bearing guide plates 242, once assembled, form a single unit that operates as a single unit. Specifically, by the shown arrangement, the pistons 236, 236 are mechanically and operationally coupled together, and move together (i.e. reciprocate left and right back-and-forth) as a single unit. The pistons 236, 236 through their respective piston rods 238, 238 and bearing guides 240, 240 together drive the motor drive shaft 214. Specifically, as shown in FIG. 6, the bearing guides 240, 240 act on the main bearing 264 of the crankpin 266 of the motor drive shaft 214.

As shown in FIG. 7, the motor drive shaft 214 is a multiple component unit. Specifically, the motor drive shaft 214 comprises a center shaft 268 accommodating the crankpin 266. A pair of flywheels 270, 270 are connected at opposite ends of the center shaft 268 (e.g. by bolting).

The motor drive shaft 214 comprises a front drive shaft 214*a* connected to the front flywheel 270. The front drive shaft 214*a* is provided with a beveled protrusion 214*b* and a flange 214*c*. A threaded connector 214*d* is received in a threaded hole 214*e* provided in a rear end of the front drive shaft 214*a*, and connects the front flywheel 270 to the front drive shaft 214*a*. The motor drive shaft 214 further comprises a rear drive shaft 214*f* connected to the rear flywheel 270. The rear drive shaft 214*f* is provided with a beveled protrusion 214*g* and a flange 214*h*. A threaded connector 214*i* is received in a threaded hole 214*j* provided in a front end of the rear drive shaft 214*f*, and connects the rear flywheel 270 to the rear drive shaft 214*f*.

A rotary position encoder puck 272 is connected to the rear end of the rear drive shaft 214*f* (e.g. by bolting). A housing 274 is connected to the rear motor cover 226. A rotary position encoder sensor 276 is connected to the inside surface of the housing 274 to support the rotary position encoder sensor 276 in a stationary position relative to the rotary position encoder magnetic puck 272, which rotates during operation of the compressed fluid motor 210.

The rotary position encoder sensor 276 detects the position of the motor drive shaft 214 and sends this real time information to the programmed logic controller (PLC) 222. By detecting the position of the motor drive shaft 214, the position of the pistons 236, 236 within the cylinders 216, 216 is also detected due the mechanical linkage or connection between the motor drive shaft 214 and the piston 236, 236 via the crankpin 266, main bearing 266, bearing guides 240, 240 and bearing guide plate 242 arrangement, and piston rods 238. Alternatively, the input to the programmable logic controller (PLC) 222 can be accomplished with a timing sensor configured to generate a timing sensor signal to be inputted into the programmed logic controller (PLC). The timing sensor, for example, can be an encoder, pick-up sensor(s), proximity sensor(s), linear transducer(s), or any combination thereof, provided on the motor drive shaft 214, an output shaft, piston, piston rods, cylinders, or combination thereof. For example, the sensing arrangement (e.g. reed switches and magnetic pistons) utilized in the embodiment shown in FIGS. 1-4 can be utilized in this embodiment instead, or in combination with the rotary position encoder sensor 276.

Figure 9:
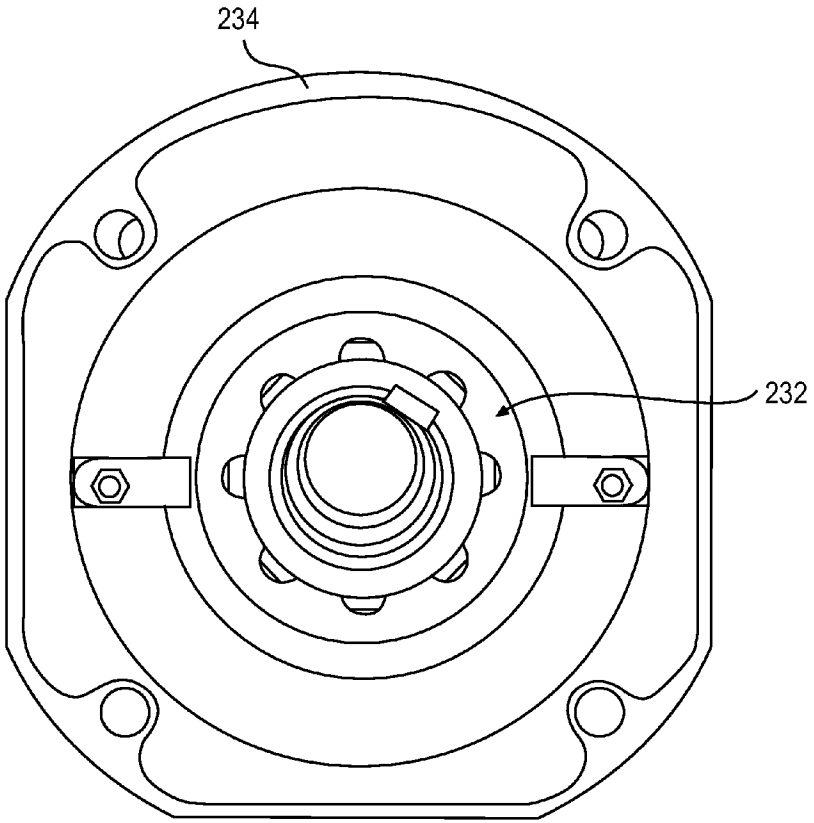
FIG. 9 is a back elevational view of the cam clutch of the advanced pressurized fluid motor shown in FIGS. 5-8.

Again, the cam clutch housing 234 is connected to the front motor cover plate 224 (e.g. by bolting), as shown in FIGS. 5 and 6. The inside of the cam clutch 232 is shown in FIG. 9. The cam clutch 232 is configured or designed to perform as a backstop, freewheel, or SPRAG type bearing. Specifically, the cam clutch 232 is configured to only allow the compressed fluid motor 210 to rotate in one direction. The direction is changeable by rotating (i.e. reversing) the cam clutch 232 to mount on an opposite side at assembly, or change by the end user by disassembly and reassembly the cam clutch 232 reversed. For example, an internal freewheel FSN manufactured by RINGSPANN can serve as the cam clutch 232.

The cylinders 216, 216 each comprise a thin walled cylinder 216*a* connecting an upper cylinder manifold 216*b* to a lower cylinder manifold 216*c*. The thin walled cylinder 216*a*, upper cylinder manifold 216*b*, and lower cylinder manifold 216*c* can be made as separate components, and then assembled together (e.g. bolting, welding, threading, mechanical connection). Seals 216*d*, 216*d* (e.g. annular seals, O-rings) can be provided in channels 216*e*, 216*e* in the outer cylinder manifold 216*b* and inner cylinder manifold 216*c*.

The upper solenoid valves 218, 218 are connected, respectively, to the outer cylinder manifolds 216*b*, 216*b* of the cylinders 216, 216. The lower solenoid valves 220, 220 are connected, respectively, to the inner cylinder manifolds 216*c*, 216*c*. For example, the solenoid valves 218, 218, 220, 220 are provided with threaded connectors 218*a*, 218*a*, 220*a*, 220*a* cooperating with threaded holes 218*b*, 218*b*, 220*b*, 220*b* provided in the sides of the solenoid valves 218, 218, 220, 220, as shown in FIGS. 5 and 6 to securely connect the solenoids and cylinder manifolds together. The solenoid valves 218, 218, 220, 220 are each connected to a pressurized fluid source (not shown). For example, the solenoid valves 218, 218, 220, 220 are connected via pressurize conduit to a pressure regulator supplied with pressurized fluid from a high pressure tank or compressor.

The cylinders 216, 216 can also be provided with additional solenoid valves or additional sets of solenoid valves to advance the operation of the pressurize fluid motor 210. For example, one solenoid valve can inject pressurized fluid into the cylinder 216 (e.g. at the upper portion and/or lower portion of the cylinder 216) and a different solenoid valve can exhaust fluid from the cylinder 216. This would allow a controlled (e.g. same or differential rate) of fluid being moved into and out of the cylinder in particular sequences for each solenoid valve. Further, the solenoid valves can be configured to provide varying pressure control and operation (e.g. flow rates and flow durations through solenoid valves can be selectively controlled by programmable logic controller (PLC) 222). In addition, the cylinders 216, 216 can be provided with one or more ports (e.g. multi-port) arrangement to facilitate exhausting the cylinders in various manner. For example, the exhaust ports can be metered to control flow rates.

The upper solenoid valves 218, 218 and lower solenoid valves 220, 220 are connected (e.g. wired or wirelessly) to the programmable logic controller (PLC) 220.

The pressurized fluid motor 210 can optionally comprise a voltage control unit (e.g. remote controlled voltage control unit) configured to control and change the voltage signals from the solenoid valves 218, 218, 220, 220 to the programmable logic controller (PLC) 220. The speed of the pressurize fluid motor 210 can be controlled and changed by controlling and changing the voltage signals from the solenoid valves 218, 218, 220, 220 without changing the input pressure supplied to the solenoid valves 218, 218, 220, 220.

In addition, the compressed fluid exhausted from the compressed fluid motor 210 can be captured for reuse. For example, the exhausted compressed fluid is at a higher pressure than ambient pressure, and requires less energy to compress up to operational supply pressure. Also, the captured exhaust can be treated (e.g. to remove moisture or foreign material), and then used for providing air conditioning, for example, to a passenger(s) of a vehicle power by the compressed fluid motor 210.

The motor body 212 can be provided with a oil fill plug 278, as shown in FIG. 6, configured to be removed to add or change motor oil within the motor body 212. The motor oil lubricates the drive shaft 214, main bearing 264, crankpin 266, bearing guides 240, bearing guide plate 242, and piston rods 238.

Figure 10:
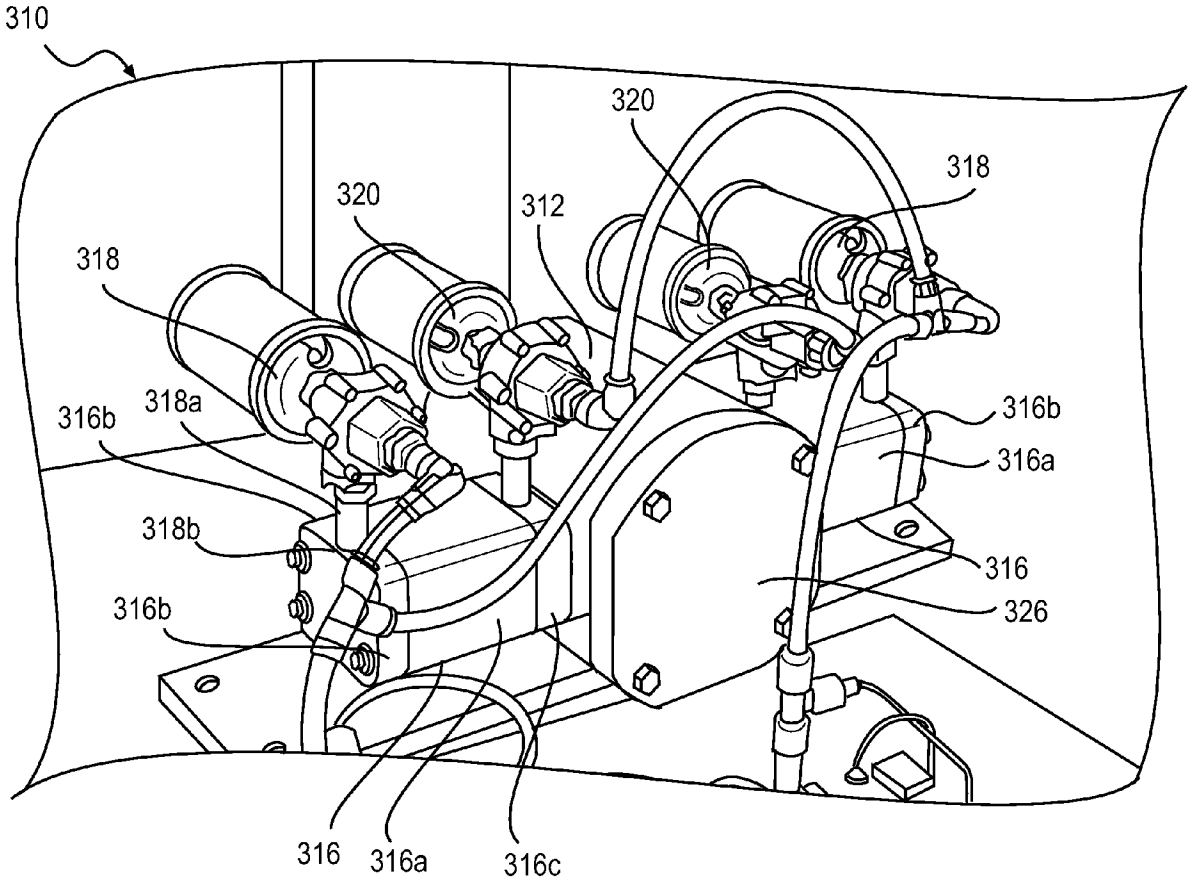
FIG. 10 is rear perspective view of a further advanced pressurized fluid motor.
Figure 11:
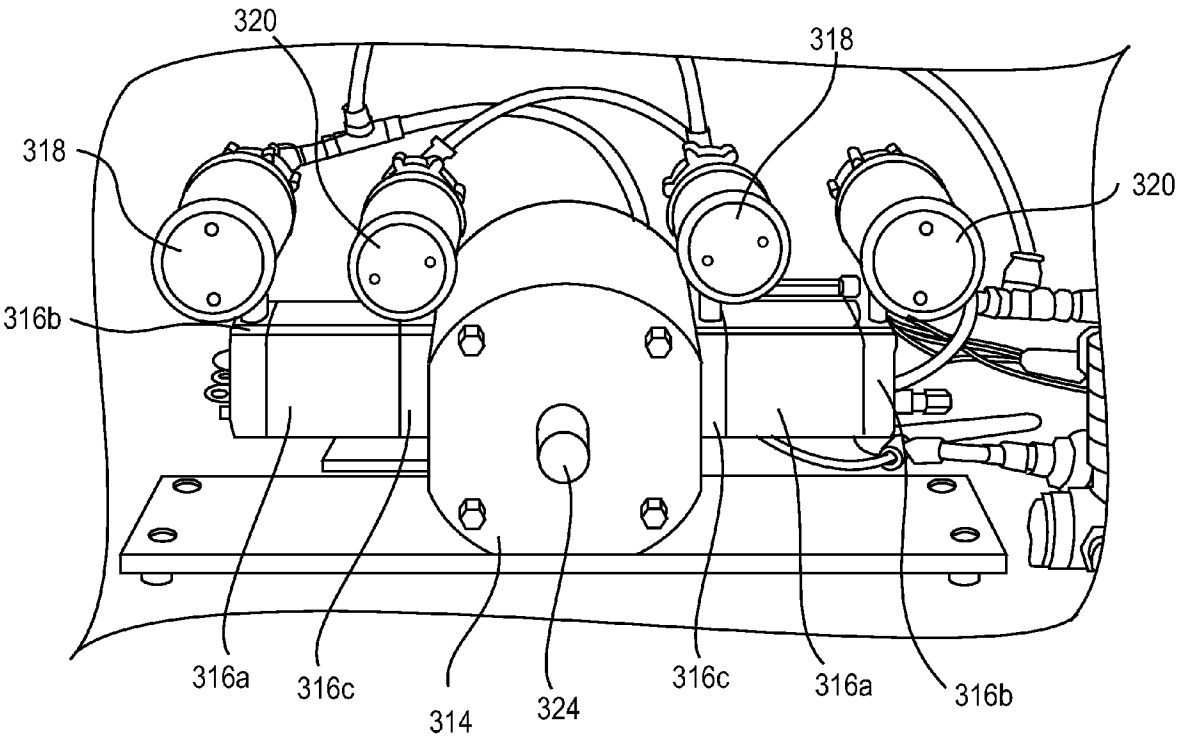
FIG. 11 is a front elevational view of the advanced pressurized fluid motor shown in FIG. 10.

A further embodiment of the compressed fluid motor 310 is shown in FIGS. 10 and 11.

The inner works of the compressed fluid motor 310 is similar to that of the compressed fluid motor 210 shown in FIGS. 5-7. However, the thin walled cylinders 216*a*, 216*a* in the compressed fluid motor 210 are replaced with rectangular-shaped outer walled cylinders 316*a*, 316*a* to accommodate bolts 316*d* internally. Further, the outer cylinder manifold 316*b* and inner cylinder manifold 316*c* have rectangular-shaped outer walls matching dimensionally (e.g. width and thickness) with the cylinders 316, 316.

Figure 12:
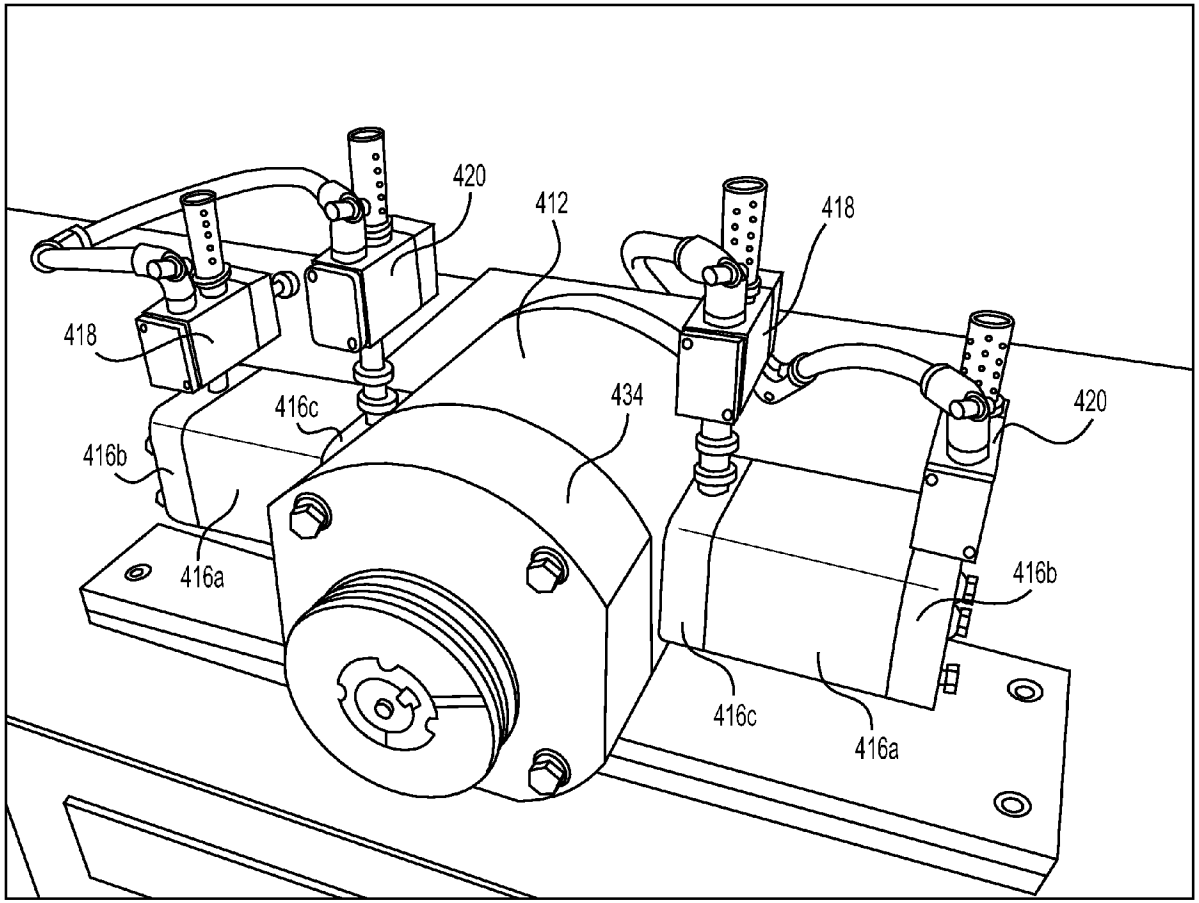
FIG. 12 is a perspective view of an even further advance pressurized fluid motor.

An even further embodiment of the compressed fluid motor 410 is shown in FIG. 12.

The inner works of the compressed fluid motor 410 is similar to that of the compressed fluid motor 210 shown in FIGS. 5-7. However, the electrical solenoid valves 218, 218, 220, 220 and electric programmable logic controller (PLC) 222 in the compressed fluid motor 210 are replaced with pneumatic operated solenoid valves 418, 418, 420, 420 and a pneumatic programmable logic controller (PLC) 422. This embodiment is useful in explosive, or wash down atmospheres.

Programmable Logic Controller (PLC)

The programmable logic controller (PLC) for use with the compressed fluid motor, for example, can be a SIMATIC S7 S7-1200 Programmable Controller manufacturer by Siemens, (https://www.automation.siements.com/mdm/default.aspx? DocVersionId=41524141835&Language=en-US&TopicId=40815534603).

Drive System

Figure 13:
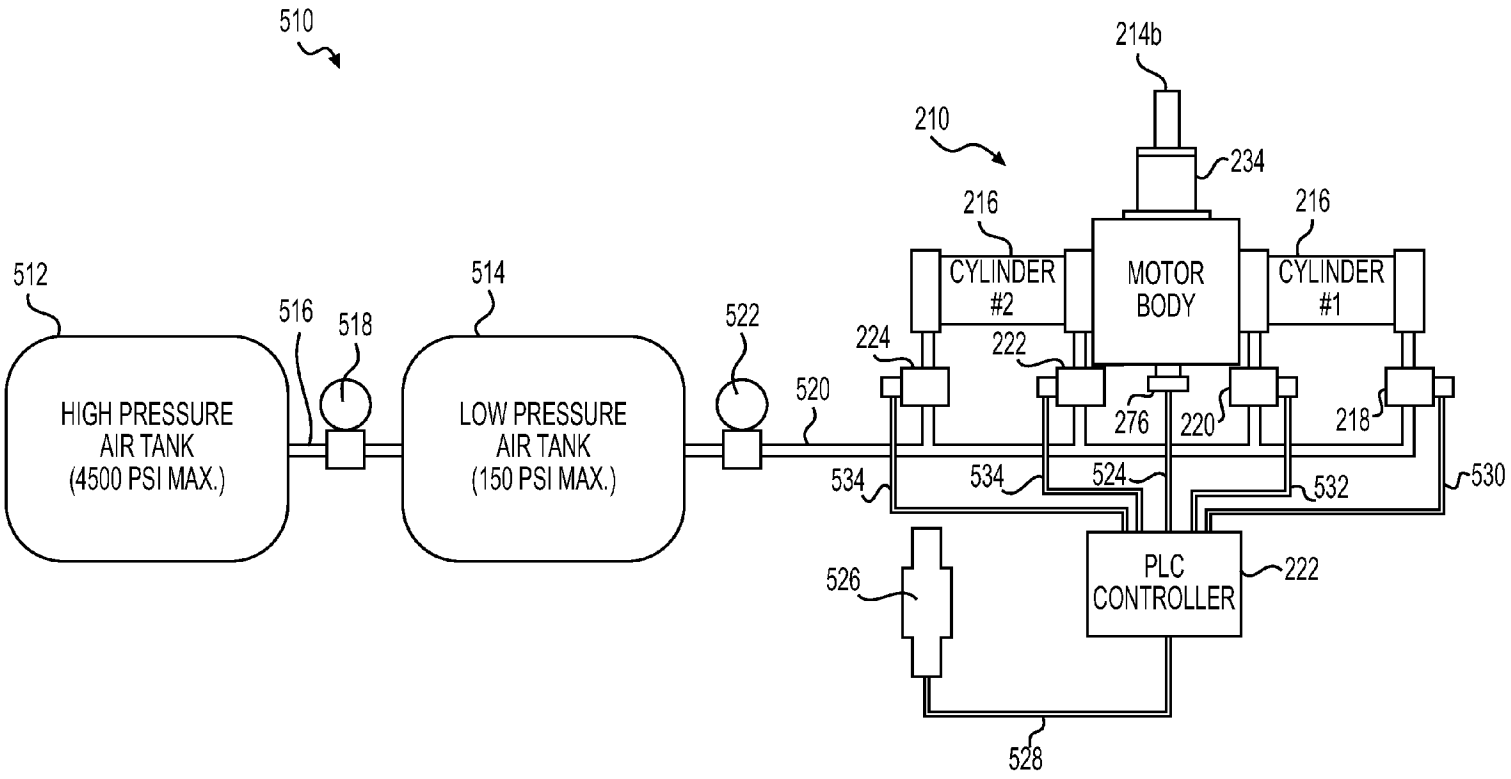
FIG. 13 is a diagrammatic view of the advanced pressurized fluid motor system.

A compressed fluid motor drive system 510 is shown in FIG. 13, including a high pressure air tank 512 connected to a lower pressure air tank 514 via a pressure line 516 fitted with a high pressure regulator 518. The lower pressure air tank 514 is connected to a pressure line 520 feeding the solenoid valves 218, 220, 222, 224 of the compressed fluid motor 210. The pressure line 520 is fitted with a low pressure regulator 522.

The programmable logic controller (PLC) 222 is connected to the rotary position encoder sensor 276 via wire 524, and connected to a linear speed controller 526 via wire 528. Further, the logic controller (PLC) 222 is connected to the solenoid valves 218, 220, 222, 224 via wires 530, 532, 534, 536.

Compressed Fluid Motor Operation

The operation of the compressed fluid motors 210 will be described below. The operation described will also apply to the compressed fluid motors 310 and 410. The operation begins by viewing the left cylinder 216 of the compressed fluid motor 210 shown in FIG. 6.

The inlet port of the upper solenoid valve 218 is operated to pressurize the upper portion of the left cylinder 216 while at the same time the lower solenoid valve 220 is operated to exhaust the lower portion of the left cylinder 216 to the atmosphere. The pressurized fluid in the upper portion of the left cylinder 216 drives the left piston 236 inwardly in the right direction towards the lower cylinder manifold 216*c*.

When the left piston 236 is reaching is lowest position (i.e. most right wise position), the lower solenoid valve 220 is operated to pressurize the lower portion of the left cylinder 216 while the upper solenoid valve 218 is operated to exhaust the upper portion of the left cylinder 216 to the atmosphere. The pressurized fluid in the lower portion of the left cylinder 216 drives the left piston 236 outwardly in the left direction towards the upper cylinder manifold 216*b*.

When the left piston 236 is reaching is highest position (i.e. most left wise position), the upper solenoid valve 218 is operated to pressurize the upper portion of the left cylinder 216 while the lower solenoid valve 220 is operated to exhaust the lower portion of the left cylinder 216 to the atmosphere. The pressurized fluid in the upper portion of the left cylinder 216 drives the left piston 236 inwardly in the right direction towards the lower cylinder manifold 216*c*. The switching of the solenoid valves 218, 220 continues to operate the pressurized fluid motor 210.

The solenoid valves 218, 220 of the right cylinder 216 and right piston 236 are operated opposite to the solenoid valves 218, 220 of the left cylinder 216 (i.e. 180*o* timing). This coordinated operation of the solenoid valves 218, 218, 220, 220 by the programmable logic controller (PLC) 222 drives the pistons 236, 236, piston rods 238, 238, bearing guides 240, 240, and bearing guide plate 242 as a single assembly back-and-forth to reciprocate same. Thus, the assembly is being driven by both piston 236, 236 at the same time in the same direction during the 360o operation of the drive shaft 214 essentially doubling the power and torque of the pressurized fluid motor 210 versus a motor configured to drive either one piston at a time or having a power stroke of the piston in only one direction.

The control of the operation of the pressurized fluid motor 210 can be programmed, for example, to vary the timing of pressurization (e.g. advance and/or retard), sequence of pressurization, dwell of pressurization to vary the performance and operation of the pressurized fluid motor 210. For example, the solenoid valves 218, 218, 220, 220 can be opened at the same time, or in a sequence, or intermittently to brake the pressurized fluid motor 220. Further, multi-port (e.g. two ports, three ports) or controllable flow rate solenoid valves or multiple solenoid valves per station can be utilized to optimize the performance and operation of the pressurized fluid motor.

Although the inventions have been described and illustrated in the above description and drawings, it is understood that this description is by example only, and that numerous changes and modifications can be made by those skilled in the art without departing from the true spirit and scope of the inventions. Although the examples in the drawings depict only example constructions and embodiments, alternate embodiments are available given the teachings of the present patent disclosure. For example, although examples for compressed fluid are disclosed, the inventions are also applicable to suction or vacuum of fluids instead of compression of fluids.

Compressed Fluid Powered Vehicle

Figure 14:
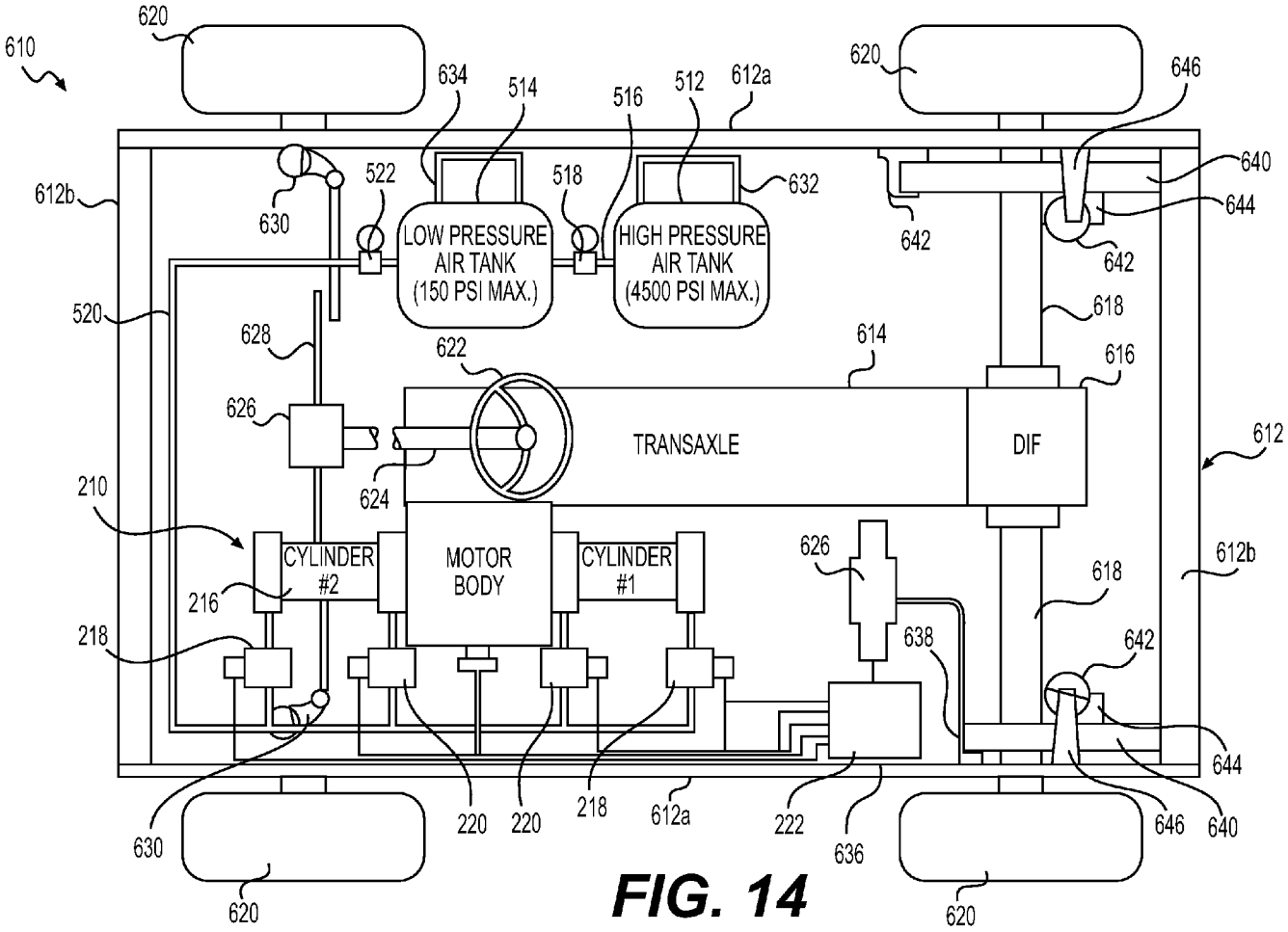
FIG. 14 is a diagrammatic view of an image of a compressed fluid power vehicle.

A compressed fluid powered vehicle 610 is shown in FIG. 14. The compress fluid powered vehicle 610 comprises a frame 612 and the compressed fluid motor 210 mounted in the frame 612.

The compressed fluid motor is coupled to a transaxle 614 having a differential unit 616 connected to a pair of axles 618, 618. The compressed fluid powered vehicle 610 is fitted with four (4) wheels (e.g. tires mounted on rims).

The front wheels 620, 620 are steerable, and the rear wheels 620, 620 are fixed on the axles 618, 618. Alternatively, the rear wheels 620, 620 can also be steerable. The vehicle steering system, for example, comprises a steering wheel 622 connected via a steering shaft 624 to a steering gearbox 626, which is coupled to a steering linkage 628. The steering linkage 628, for example, comprises a Pitman arm, track rod, idler arm, and a pair of tie rods connected to steering arms 630, 630.

The frame 612 comprise a pair of side rails 612*a*, 612*a*, connected together by a pair of cross members 612*b*, 612*b*. The high pressure tank 512 is connected to the right side frame 612*a* by a mounting bracket 632, and lower pressure tank 514 is connected to the left side frame 612*a* by a mounting bracket 634. The high pressure regulator 518 is positioned in-line with the high pressure line 516, and the lower pressure regulator 522 is positioned in-line with the lower pressure line 520. The lower pressure line 520 supplies pressurized fluid to the solenoid valves 218, 220, 220, 218 of the compressed fluid motor 210.

The programmable logic controller 222 is mounted to the left frame rail 612*a* by a mounting bracket 636. The linear speed controller 526 is mounted to the left frame rail 612*a* by a mounting bracket 638.

A pair of leaf springs 640, 640 are each connected at a rear end to the cross member 612*b* (e.g. via a bracket, not shown). The front ends of the leaf springs 640, 640 are each connected to a mounting bracket 642 connected to a side rail of the frame 612. A pair of shock absorbers 642, 642 are connected at their lower ends to mounting brackets 644, 644 connected to the axles 618, 618. The upper ends of the shock absorbers 642, 642 are connected to frame towers or brackets 646, 646.

What is claimed is:

1. A compressed fluid motor, comprising:
- a motor unit comprising a plurality of cylinders;
- a drive shaft rotatably disposed within the motor unit;
- a piston slidably disposed within each cylinder;
- a piston rod connecting each piston to the drive shaft;
- a timing sensor configured to generate an electrical timing sensor signal to be used to control timing of the motor;
- at least one solenoid valve in fluid communication with each cylinder; and
- a programmable logic controller configured to receive the timing signal generated by the electrical timing sensor and generate an output controlling the operation of the at least one solenoid valve of each cylinder to control and operate the compressed fluid motor.

2. The motor according to claim 1, wherein the timing sensor is a position sensor configured to sense a particular rotational position of the drive shaft and generate a reference signal for timing the motor.

3. The motor according to claim 2, wherein the position sensor comprises a rotary position encoder sensor cooperating with a rotary position encoder puck.

4. The motor according to claim 3, wherein the rotary position encoder puck is connected to one end of the drive shaft, and the rotary position encoder sensor is connected to a housing of the motor in proximity to the rotary position encoder puck.

5. The motor according to claim 1, wherein the at least one solenoid valve is an upper solenoid valve operationally connected to an upper portion of the cylinder and a lower solenoid valve operationally connected to a lower portion of the cylinder.

6. The motor according to claim 4, wherein the at least one solenoid valve is an upper solenoid valve operationally connected to an upper portion of the cylinder and a lower solenoid valve operationally connected to a lower portion of the cylinder.

7. The motor according to claim 5, wherein each cylinder comprises an upper cylinder manifold and a lower cylinder manifold, the upper solenoid valve being connected to the upper cylinder manifold and the lower solenoid valve being connected to the lower cylinder manifold.

8. The motor according to claim 7, wherein the solenoid valves are connected to respective sides of the cylinder manifolds.

9. The motor according to claim 1, further comprising a cam clutch connected to the motor body and drive shaft, the cam clutch configured to only allow the drive shaft to rotate in one direction.

10. The motor according to claim 1, wherein the piston comprises an inner piston body connected to an outer piston body.

11. The motor according to claim 10, wherein the piston is connected to an end of the piston rod by a fastener.

12. The motor according to claim 1, wherein the piston rod is connected to a bearing guide by a pin, and the bearing guide rides on a crankpin of the drive shaft.

13. The motor according to claim 1, wherein the compressed fluid motor comprises a pair of opposed cylinders.

14. The motor according to claim 1, wherein the at least one solenoid valve is an electronic solenoid valve, and the programmable logic controller is an electronic programmable logic controller.

15. The motor according to claim 14, wherein the at least one electronic solenoid valve is wired to the electronic programmable logic controller.

16. The motor according to claim 14, wherein the at least one electronic solenoid is wirelessly linked to the electronic programmable logic controller.

17. The motor according to claim 1, wherein the at least one solenoid valve is a pneumatic solenoid valve, and the programmable logic controller is a pneumatic programmable logic controller.

18. The motor according to claim 17, wherein the at least one pneumatic solenoid valve is connected via a pressure conduit to the pneumatic programmable logic controller.

19. The motor according to claim 1, wherein the cylinder comprises an upper cylinder manifold connected to a lower cylinder manifold by a thin walled cylinder.

20. A compressed fluid motor vehicle, comprising the compressed fluid motor according to claim 1.

21. The motor according to claim 1, wherein the timing sensor is a position sensor for referencing a position of at least one movable component of the motor to generate a timing signal.

22. The motor according to claim 21, wherein the position sensor comprises a rotary position encoder sensor cooperating with a rotary position encoder puck.

23. The motor according to claim 1, wherein the motor comprises a motor body and the plurality of cylinders are connected to the motor body.

24. The motor according to claim 23, wherein the plurality of cylinders are separate components connected to the motor body when assembled.

25. The motor according to claim 1, wherein the plurality of cylinders are multiples of two cylinders.

* * * * *